United States Patent [19]

Punakivi

[11] Patent Number: 4,545,503

[45] Date of Patent: Oct. 8, 1985

[54] GATE FOR BARKING DRUM AND METHOD OF CLOSING

[75] Inventor: Tapio Punakivi, Luvia, Finland

[73] Assignee: Rauma-Repola Oy, Pori, Finland

[21] Appl. No.: 685,150

[22] Filed: Dec. 21, 1984

[30] Foreign Application Priority Data

Dec. 22, 1983 [FI] Finland ..... 834755

[51] Int. Cl.[4] ..... B65D 43/20

[52] U.S. Cl. ..... 220/345; 220/331

[58] Field of Search ..... 220/331, 345

[56] References Cited

U.S. PATENT DOCUMENTS

| | | | |
|---|---|---|---|
| 4,155,476 | 5/1979 | Lipiee et al. | 220/345 |
| 4,192,435 | 3/1980 | Volpeliere | 220/331 |
| 4,267,936 | 5/1981 | Pavlicek | 220/345 |

*Primary Examiner*—George T. Hall

*Attorney, Agent, or Firm*—Burns, Doane, Swecker & Mathis

[57] ABSTRACT

Method for closing the gate of a rotary barking drum intended for barking of wood, and the gate of a barking drum. The gate is rotated so that it is shifted so as to close the discharge opening at the end of the barking drum partly or completely. During the closing movement, the center of the movement of rotation of the gate (1) is shifted and approaches the center of the cross-section of the drum. For the control of the closing movement, the gate is provided with two support members (2, 3), which can be displaced in a plane parallel to the gate along one common guide (4, 5) or along two separate guides. At least a part of the guide (4, 5) or guides is curved in the same direction as the mantle of the barking drum is curved. The curve radius of the guide (4) intended for the support member (2) of the gate that runs as the first support member during a closing movement is shorter than the curve radius of the guide (5) intended for the support member (3) of the gate that runs as the rearmost support member during a closing movement.

9 Claims, 3 Drawing Figures

GATE FOR BARKING DRUM AND METHOD OF CLOSING

Figure 1A:
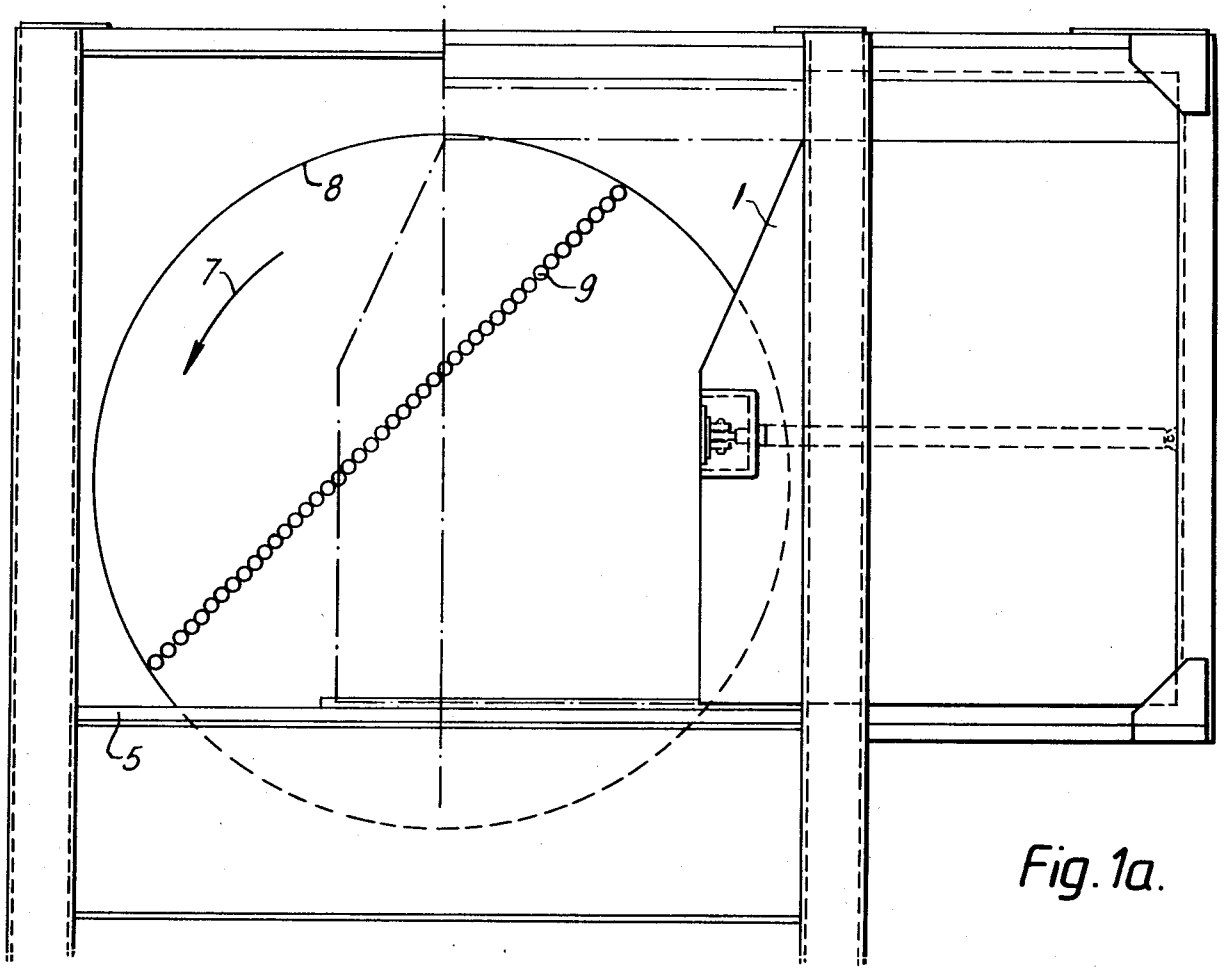

The present invention is concerned with a method for closing the gate of a rotary barking drum intended for barking of wood, whereby the gate is rotated so that it is shifted so as to close the discharge opening at the end of the barking drum partly or completely. The invention is also concerned with a gate for closing the end of a rotary barking drum intended for barking of wood partly or completely, whereby, for the control of the closing movement, the gate is provided with two support members, which can be displaced in a plane parallel to the gate along one common guide or along two separate guides.

Thus, the present invention is concerned with a closing member for the discharge end of a barking drum, by means of which the quantity of the barked flow of wood is controlled when it is discharged out of the barking drum onto the conveyor.

At present, closing gates that move either horizontally or vertically are used as the closing members.

The operation of a horizontal gate, however, involves, e.g., the following drawbacks: The movement of closing is slow, and the final movement of complete closing is impossible as the gate acts as a woodchopping cutter.

The operation of a vertical gate involves the following drawbacks: unduly high power required for the closing, the whole own weight of the vertical gate plus the weight of the wood mass placed on the gate. At the final part of the closing movement, the falling height of the wood is so high that the mechanical strain on the receiving conveyor is unduly high.

The object of the present invention is to provide a closing gate for a barking drum in whose operation the drawbacks of the above gate types have been eliminated. The method in accordance with the invention for closing the gate of a barking drum is characterized in that, during the closing movement, the centre of the movement of rotation of the gate is shifted and approaches the centre of gravity of the gate. The gate of a barking drum in accordance with the invention is characterized in that at least a part of the guide or guides is curved in the same direction as the mantle of the barking drum is curved and that the curve radius of the guide intended for the support member of the gate that runs as the first support member during a closing movement is shorter than the curve radius of the guide intended for the support member (3) of the gate that runs as the rearmost support member during a closing movement.

By means of the swinging gate in accordance with the invention for a barking drum, the following advantages are obtained:

1. Complete closure of the necessary closing area by means of correct geometric design of the gate.
2. Low requirement of closing power within the initial part of the closing movement because the centre of gravity of the gate rises gently upwards at an angle of about 30°. During the final closing, when the swinging movement approaches circular movement, the centre of gravity remains almost stationary, whereby just a power overcoming the frictional forces is adequate as the closing power.
3. The speeds of closing and opening are high near the closed position, because the power requirement is in that position at the minimum. Thereby, a control of maximum rapidity is achieved for the discharge flow of the wood.
4. When the horizontal speed of the closing movement is invariable, the vertical speed is increasing within an essential range of control of the gate when a closing of maximum rapidity is required.
5. The falling height of the wood onto the receiving conveyor is reduced essentially, as a comparison between the same opening positions.

Figure 1B:
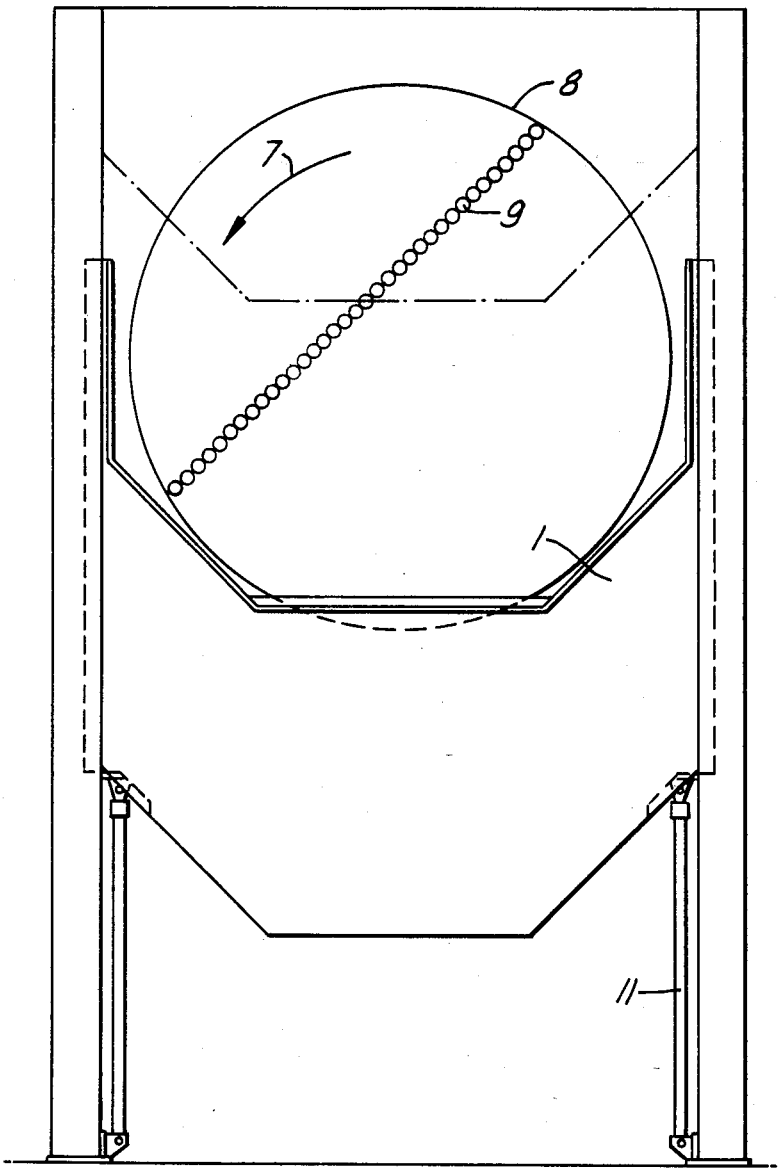
Figure 2:
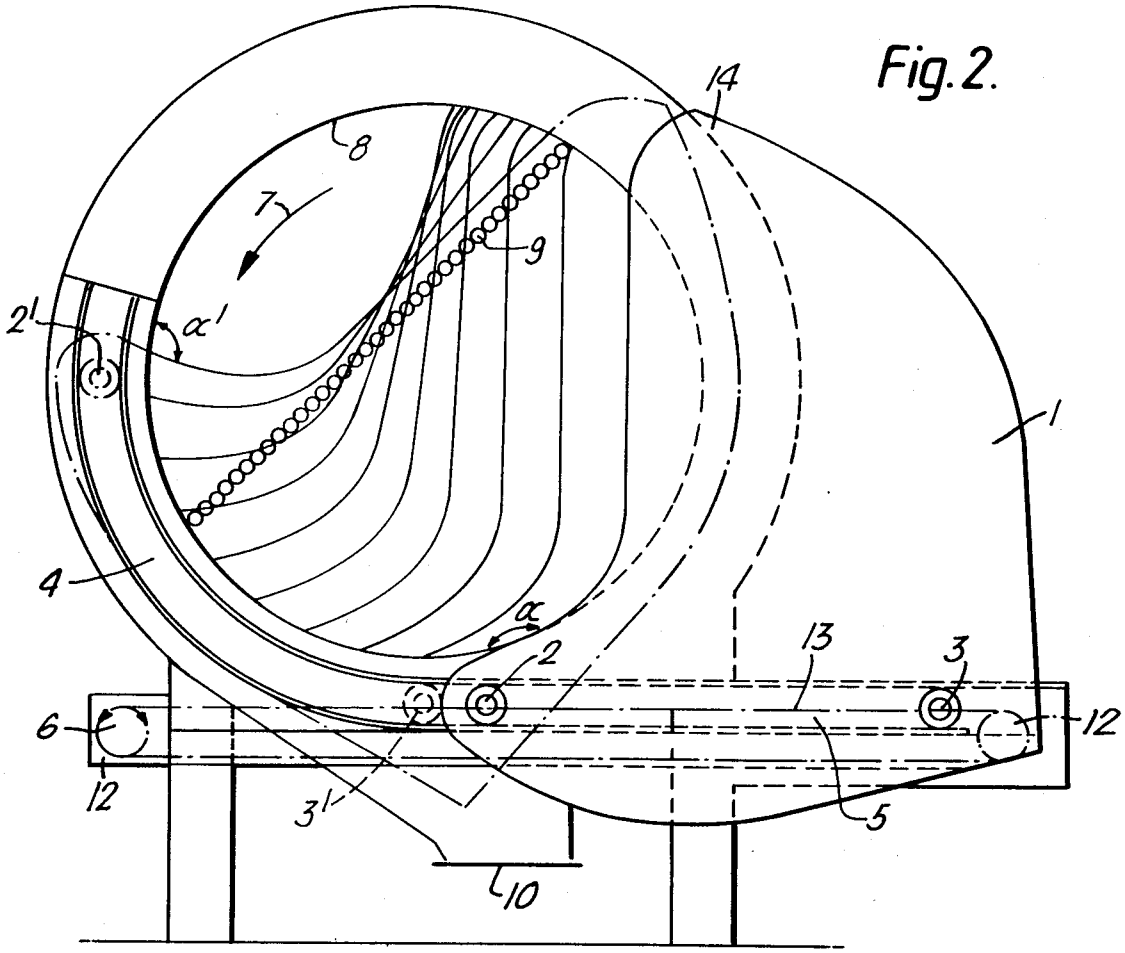

In the following, the gate of a barking drum in accordance with the invention will be described with reference to the attached figures, wherein FIG. 1*a* shows a horizontal gate, FIG. 1*b* shows a vertical gate, and FIG. 2 is an end view of a swinging gate in accordance with the present invention for a barking drum.

The prior-art horizontal gate (FIG. 1*a*) is provided with a horizontal rail 5, on which the horizontal gate 1 moves and, when moving from the right to the left, closes the discharge opening 8 of the barking drum, of a shape of a segment of a circle. The closed position is illustrated by means of dotted broken lines. The barking drum revolves in the direction of the arrow 7, whereby the wood in the drum takes such a position that its topmost portion 9 is placed at the position illustrated in the figure.

In the prior-art vertical gate (FIG. 1*b*), the gate 1 is supported on hydraulic cylinders 11. The closing movement is directed from the bottom upwards and partly closes the circular discharge opening 8 of the barking drum.

The swinging gate 1 in accordance with the present invention for a barking drum is provided with two support wheels or glide members 2 and 3. The support members move from the right to the left, when the gate is being closed, along a support track. The portion 4 provided for the foremost support member 2 in the support track is curved in such a way that it rises upwards as substantially parallel to the mantle of the barking drum. The portion 5 of the support track provided for the rearmost support member 3 is substantially horizontal. Near the rearmost support member 3, the machine elements intended for the transmission of the gate shifting movement are attached, e.g. a hydraulic cylinder, chain or steel rope. In the embodiment shown in FIG. 2, an endless chain or steel rope 13 running around two wheels 12 is used. One of the wheels 12 is provided with a drive mechanism 6 for the shifting device. The upper corner 14 of the swinging gate is supported in an appropriate way, e.g. by fitting a support plate (not shown in the drawing) in front of it.

The direction of rotation of the barking drum is indicated by the arrow 7. The wood discharge opening 8 of the barking drum is of circular shape. The maximum filling rate of the wood in the barking drum is indicated by the wood 9. By means of the swinging gate of a barking drum in accordance with the present invention, the area below the maximum wood filling rate is closed and opened so as to obtain a desired magnitude of the flow of wood onto the conveyor 10.

In FIG. 2, the swinging gate of the barking drum is shown to the right in the fully opened position. When the gate is being closed, the drive mechanism 6 drives the wheel 3 to the left, by means of the chain 13, along the right horizontal portion 5 of the support track until the wheel reaches the position 3'. At the same time, the wheel 2 rises along the left curved portion 4 of the support track upwards to the position 2'. The edge of the gate that moves ahead during the closing movement is shaped so that its main part is positioned vertically in the opened position and almost parallel to the top face of the wood 9 in the closed position. The end next to the front wheel 2 is, however, curved in such a way that there is a projecting cam on the gate at the wheel 2. Thereby, when the gate is being closed, no acute angle $\alpha/\alpha'$ is formed between the edge of the gate and the drum opening 8 wherein the wood might be wedged and jammed. Thus, the profile of the front edge of the gate of the drum has been chosen geometrically correctly so that, in the closed position, the gate closes the necessary area of the circular cross-sectional area completely.

Thus, the swinging gate of a barking drum in accordance with the present invention is provided with a geometrically correctly shaped closing plate, whose movements consist of a combination of a unidirectional movement and a rotary movement. A closing plate 1 is shifted to the front of the circular discharge opening 8 of the barking drum, the two separate support members 2 and 3 of the said closing plate running, during the closing movement, along different positively controlled tracks 4 and 5, and the unidirectional movement at the beginning of the closing movement is, towards the end of the closing movement, converted to a rotary movement taking place around the centre of the barking drum.

The force that produces the closing movement hydraulically or mechanically is applied to the rearmost support member 3 of the swinging gate, whose path of movement is a unidirectional movement throughout the entire closing movement. By means of the correct geometry of the swinging gate, the advantage is obtained that no wedging takes place during the closing movement, but the front edge of the swinging gate, all the time, lifts the wood placed on it upwards.

During the initial part, the opening movement is aided, when the gate is revolving towards the open position, by the mass of wood revolving in the same direction inside the barking drum.

When the power available for the closing movement is invariable, the final closing of the swinging gate can be made accelerating. In view of the process, this is highly important in order to produce a rapid movement of the gate for the purpose of controlling the flow of wood that is being discharged.

The invention is not restricted to the embodiment described above only, but it may show variation in many ways within the scope of the patent claims. In stead of one unified guide, it is possible to use a separate guide for each of the support members 2 and 3. The portion 5 of the guide may also be gently curved.

In the present application, the centre point of the movement of rotation of the gate means the intersection of the normals of the momentary directions of movement of the support members 2 and 3. In the case of a unidirectional movement, this intersection is placed infinitely far away, and it coinicides with the centre of the drum when both of the support members run along a track of a shape equal to the shape of the circumference of the drum.

What is claimed is:

1. Method for closing the gate of a rotary barking drum intended for barking of wood, whereby the gate is rotated so that it is shifted so as to close the discharge opening at the end of the barking drum partly or completely, c h a r a c t e r i z e d in that, during the closing movement, the centre of the movement of rotation of the gate (1) is shifted and approaches the centre of the cross-section of the drum.

2. Method as claimed in claim 1, c h a r a c t e r i z e d in that, during the movement of closing, the centre of the movement of rotation of the gate is shifted from outside the barking drum to inside the barking drum.

3. Method as claimed in claim 2, characterized in that the movement of closing of the gate substantially consists of combinations of a linear movement and a rotary movement, whereby, during the movement of closing, the centre of the rotary movement is shifted from infinity to the centre axis of the barking drum or to the proximity of the said axis.

4. Gate (1) for closing the end (8) of a rotary barking drum intended for barking of wood partly or completely, whereby, for the control of the closing movement, the gate is provided with two support members (2, 3), which can be displaced in a plane parallel to the gate along one common guide (4, 5) or along two separate guides, c h a r a c t e r i z e d in that at least a part of the guide (4, 5) or guides is curved in the same direction as the mantle of the barking drum is curved and that the curve radius of the guide (4) intended for the support member (2) of the gate that runs as the first support member during a closing movement is shorter than the curve radius of the guide (5) intended for the support member (3) of the gate that runs as the rearmost support member during a closing movement.

5. Gate of a barking drum as claimed in claim 4, c h a r a c t e r i z e d in that the curved guide (4) intended for the foremost support member (2) of the gate (1) is substantially concentric with the opening (8) of the barking drum and that the guide (5) intended for the rearmost support member (3) of the gate is substantially horizontal.

6. Gate of a barking drum as claimed in claim 4, c h a r a c t e r i z e d in that the edge of the gate (1) that runs ahead during a closing movement is shaped so that, in the closed position of the gate and when the drum revolves, the main part of the front edge of the gate is substantially at the same level as the top edge of the wood material contained in the drum.

7. Gate of a barking drum as claimed in claim 6, c h a r a c t e r i z e d in that, in the opened position of the gate (1), the main part of the front edge of the gate is positioned substantially vertically and that the end of the front edge of the gate placed next to the foremost support member (2) is provided with a projecting cam, which is shaped so that, in all positions of the gate, in the open part remaining between the cam and the discharge opening of the drum, the angle ($\alpha/\alpha'$) between the cam and the opening is at least 90°.

8. Gate of a barking drum as claimed in claim 5, characterized in that the edge of the gate (1) that runs ahead during a closing movement is shaped so that, in the closed position of the gate and when the drum revolves, the main part of the front edge of the gate is substantially at the same level as the top edge of the wood material contained in the drum.

9. Gate of a barking drum as claimed in claim 8, characterized in that, in the opened position of the gate (1), the main part of the front edge of the gate is positioned substantially vertically and that the end of the front edge of the gate placed next to the foremost support member (2) is provided with a projecting cam, which is shaped so that, in all positions of the gate, in the open part remaining between the cam and the discharge opening of the drum, the angle ($\alpha/\alpha'$) between the cam and the opening is at least 90°.

* * * * *